US009302837B2

(12) United States Patent
Martin et al.

(10) Patent No.: US 9,302,837 B2
(45) Date of Patent: Apr. 5, 2016

(54) METHOD FOR EASILY OPENING A HEAT-SEALED SEAL ON THE LOCKING RING OF A GLASS CONTAINER

(75) Inventors: Eric Martin, Fontenay Aux Roses (FR); Boris Chauvet, Chalon sur Saone (FR); Frederic Mertz, Ouroux sur Saone (FR)

(73) Assignee: SAINT-GOBAIN EMBALLAGE, Courbevoie (FR)

( * ) Notice: Subject to any disclaimer, the term of this patent is extended or adjusted under 35 U.S.C. 154(b) by 904 days.

(21) Appl. No.: 13/577,086

(22) PCT Filed: Jan. 26, 2011

(86) PCT No.: PCT/FR2011/050148

§ 371 (c)(1), (2), (4) Date: Oct. 26, 2012

(87) PCT Pub. No.: WO2011/095726

PCT Pub. Date: Aug. 11, 2011

(65) Prior Publication Data

US 2013/0036715 A1 Feb. 14, 2013

(30) Foreign Application Priority Data

Feb. 3, 2010 (FR) ..... 10 50738

(51) Int. Cl.
*B65D 77/20* (2006.01)

(52) U.S. Cl.
CPC ..... *B65D 77/2032* (2013.01)

(58) Field of Classification Search
CPC ..... B67B 7/00; B67B 7/12; B67B 6/00; B65D 39/00; B65D 39/0029; B65D 39/0076; B65D 39/08; B65D 39/10; B65D 41/02; B65D 77/2032; B03B 7/06
USPC ..... 53/492
See application file for complete search history.

(56) References Cited

U.S. PATENT DOCUMENTS

| | | | | | |
|---|---|---|---|---|---|
| 3,748,816 | A * | 7/1973 | Asmus | B65D 45/00 | 53/420 |
| 4,180,961 | A * | 1/1980 | Collins, III | B65D 43/0212 | 53/421 |
| 4,396,655 | A * | 8/1983 | Graham | B65D 51/20 | 156/308.4 |
| 4,442,129 | A * | 4/1984 | Niwa | B65B 7/2878 | 156/321 |
| 4,771,903 | A * | 9/1988 | Levene | B65B 7/2878 | 156/69 |
| 4,858,780 | A | 8/1989 | Odaka et al. | | |
| 4,913,307 | A | 4/1990 | Takata et al. | | |
| 4,961,513 | A * | 10/1990 | Gossedge | B29C 65/18 | 156/69 |
| 5,042,226 | A * | 8/1991 | Osip et al. | 53/412 | |
| 5,062,569 | A * | 11/1991 | Hekal | 206/467 | |
| 5,160,391 | A * | 11/1992 | Thomas, Jr. | 156/69 | |
| 7,364,779 | B2 * | 4/2008 | Nomula | 428/36.7 | |
| 8,308,003 | B2 * | 11/2012 | O'Brien et al. | 215/232 | |
| 8,763,890 | B2 * | 7/2014 | Clark et al. | 229/120.09 | |
| 9,079,374 | B2 * | 7/2015 | Hewitt | B32B 7/06 | |
| 2008/0296198 | A1 * | 12/2008 | Chamorot et al. | 206/528 | |
| 2011/0017772 | A1 * | 1/2011 | Jacoulet et al. | 222/1 | |
| 2011/0155687 | A1 * | 6/2011 | Ammann | B65D 51/228 | 215/252 |
| 2012/0045554 | A1 * | 2/2012 | Carvin | A47G 19/2205 | 426/106 |
| 2012/0285920 | A1 * | 11/2012 | McLean et al. | 215/230 | |
| 2014/0166682 | A1 * | 6/2014 | Huffer | 220/780 | |

FOREIGN PATENT DOCUMENTS

EP 0 306 982 3/1989

OTHER PUBLICATIONS

"Adhesion Strength Study of EVA Encapsulants on Glass Substrates"; F. J. Pern and S.H. Glick; pp. 1-7; Mar. 24-26, 2003.*
"Peeling Test", Com=Ten Industries; Mar. 14, 2011; pp. 1-3 (http://www.com-ten.com/define-peel-strength.html).*
International Search Report Issued May 10, 2011 in PCT/FR11/050148 Filed Jan. 26, 2011.

* cited by examiner

*Primary Examiner* — Gloria R Weeks
(74) *Attorney, Agent, or Firm* — Oblon, McClelland, Maier & Neustadt, L.L.P.

(57) ABSTRACT

A method for opening a seal including a metal foil and a layer of thermoplastic resin via which the seal is heat-sealed to the rim of a glass jar or equivalent container, the rim having been coated beforehand with a heat-sealing primer, the heat-sealed seal providing hermetic closure of the glass jar or equivalent container, where the initial and final tear forces are not more than 28 N on peeling of the seal at 90° at a speed of 300 mm/min; a glass jar or equivalent container suitable for implementation of this method, where the coating of heat-sealing primer contains an organic and/or inorganic material in which organic and/or inorganic fillers are incorporated; and the application of this method or this glass jar or equivalent container to the packaging of processed food products.

18 Claims, No Drawings

METHOD FOR EASILY OPENING A HEAT-SEALED SEAL ON THE LOCKING RING OF A GLASS CONTAINER

CROSS-REFERENCE TO RELATED APPLICATIONS

The present application is a 35 U.S.C. §371 national stage patent application of International patent application PCT/FR2011/050148, filed on Jan. 26, 2011, the text of which is incorporated by reference, and claims the benefit of the filing date of French application no. 10 50738, filed on Feb. 3, 2010, the text of which is also incorporated by reference.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF THE MATERIAL ON THE COMPACT DISC

Not Applicable.

BACKGROUND OF THE INVENTION

1. Field of the Invention

The present invention relates to glass packaging (jar, wide-mouth flask, bottle, decanter, etc.) having a rim which constitutes a surface of any desired geometry (annular, oval, substantially rectangular or other) and on which a metal seal is heat-sealed, providing a hermetic closure.

The rim is initially coated with a layer of heat-sealing primer, while the seal comprises a layer of thermoplastic resin which allows heat-sealing to take place by the application of an adequate temperature and of pressure.

2. Description of the Related Art Including Information Disclosed Under 37 CFR 1.97 and 1.98

The problems confronting a user of this technique are of a number of orders.

It is, of course, of prime importance to ensure durable hermetic closure under the conditions in which the packaged product is used, which may include changes in temperature and even biological transformations such as fermentation. The preservation of the product while respecting the conditions laid down for that purpose must also be ensured.

The major problem posed by this technique lies in the often excessive force to be expended in order to open the packaging by peeling of the seal. This excessive force may make the operation difficult for a young child or a relatively weak person. Moreover, this difficulty in opening is often accompanied by the tearing of the seal into a number of pieces, accompanied by residues of thermoplastic resin from the seal which are left adhering to the heat-sealing surface.

Consideration might be given to employing complex, multilayer polymeric seals incorporating a cohesive fracture layer, but the heat-sealing surface of the opened packaging likewise has sticky residues of thermoplastic resin originating from the seal.

The objective of the inventors was therefore to solve these problems.

BRIEF SUMMARY OF THE INVENTION

The inventors achieved this objective by means of the invention, which provides a method for opening a seal comprising a metal foil and a layer of thermoplastic resin via which the seal is heat-sealed to the rim of a glass jar or equivalent container, said rim having been coated beforehand with a heat-sealing primer, the heat-sealed seal providing hermetic closure of the glass jar or equivalent container; this method is distinguished by the fact that the initial and final tear forces are not more than 30 N on peeling of the seal at 90° at a speed of 300 mm/min.

Accordingly, it is easy to open the packaging even for a relatively weak person, and the tearing of the seal into a number of pieces in the course of its peeling is avoided. This easy opening is now obtained while meeting the requirements of durable sealing which are necessary for all contents, especially food products.

BRIEF DESCRIPTION OF THE SEVERAL VIEWS OF THE DRAWINGS

Not Applicable.

DETAILED DESCRIPTION OF THE INVENTION

According to preferred features of the method of the invention:

- the initial and final tear forces are not more than 28, preferably 25 N;
- opening the seal does not leave any residue of its thermoplastic resin layer on the rim of the glass container.

The invention further provides a glass jar or equivalent container (bottle, flask, decanter, etc.) suitable for implementation of the method described above, characterized in that the coating of heat-sealing primer comprises an organic and/or inorganic material in which organic and/or inorganic fillers are incorporated.

In one particularly advantageous embodiment, said organic material is the product of drying an aqueous dispersion of ethylene-acrylic acid copolymer whose carboxylic acid functions are partly or totally neutralized. This organic material may be a single material or may be combined with at least one other organic and/or inorganic material—in addition to the fillers—in the heat-sealing primer. This copolymer is solid and stable in its suspension at ambient temperature; implementation by an aqueous route is advantageous.

Furthermore, the resulting jar coated with heat-sealing primer may be delivered immediately to its user/filler, thereby removing the need to store greater or lesser volumes of jars before they are delivered.

The heat-sealing primer may comprise organic or inorganic fillers of a single chemical type or of two or more chemical types; only inorganic or only organic fillers, or both in combination.

Said inorganic fillers are preferably incorporated in the dispersions of heat-sealing primer in the form of aggregates or a powder of solid particles with sizes of between 1 nm and 20 μm, preferably between 150 nm and 10 μm, of one or more materials selected from clays, kaolin, mica, talc, silicas, carbonates or sulfates of alkaline earth metals, and metal oxides.

When organic fillers are employed, they are advantageously chemically different from the heat-sealing primer (i.e., from its constituent material with the exception of the fillers) and from the thermoplastic resin of the seal, have a melting temperature greater than that of these two constituents, and consist of particles with sizes of between 1 nm and 20 μm, preferably between 150 nm and 10 μm. Said organic fillers preferably comprise one or more polymers assembled in the form of a copolymer, graft polymer, alloy or core-shell structure, selected from high-density polyethylene (HDPE), polypropylene (PP), polystyrene (PS), polyamide (PA), polyester, polyvinylidene fluoride (PVDF), polytetrafluoroethylene (PTFE), poly(ethylene glycol) (PEG), poly(ethylene terephthalate) (PET), polymethyl methacrylate (PMMA), and polyetheretherketone (PEEK) polymers.

The dry thickness of heat-sealing primer coating on the rim of the glass container is advantageously at least 0.2, preferably 0.9, and more preferably 1.5 μm;

not more than 4, preferably 3, and more preferably 2 μm.

The invention additionally provides the application of an above-described method, or of an above-described glass pot or equivalent container, to the packaging of processed food products, such as dairy products or products based on fruit or on meat (pâté, etc.). The invention, indeed, ensures the preservation of the contents while respecting the conditions, especially temperature conditions, laid down for this purpose, and the sealing of the packaging under such conditions of preservation of the contents.

The invention is now illustrated by the following examples.

EXAMPLE 1

Comparative

The components used are a standard glass jar of yoghurt pot type, having an external collar diameter of 54.4 mm and a rim width of 4.2 mm, and a seal composed of an aluminum foil with a thickness of 47 μm and of a layer of thermoplastic resin applied at 30 g/m$^2$, this seal being sold by the company Alcan Packaging under the name Aluthène® 50 II E 114/2.

A roller is used to apply a coating of heat-sealing primer to the rim of the jar. Any other method, by contact, such as immersion, brush, pad, etc., or without contact, such as spraying, atomizing, etc., may be employed.

The heat-sealing primer is organic and consists of an aqueous dispersion of random linear ethylene-acrylic acid copolymer with a weight-average molecular weight $M_w$ of approximately 33 000 g/mol expressed as polystyrene equivalent. The copolymer contains 9.1% of acrylic acid units and 90.9% of ethylene units. The carboxylic acid functions of the poly (ethylene-carboxylic acid) ionomer are 100% neutralized with aqueous ammonia. The pH of the suspension is adjusted to between 8.5 and 9. Depending on the application method used, the solids content of heat-sealing primer employed varies from 0.2% to 10% by mass; in the present case it is 9.5% by mass.

This material exhibits a broad melting peak at between 70 and 95° C. (Differential Scanning Calorimetry—DSC—15° C/min). The infrared profile of this material in dry extract form exhibits a ratio of C—H (3020-2736 cm$^{-1}$) to C═O (1772-1633 cm$^{-1}$) peaks of 3.2.

The heat-sealing surface of the glass jar is covered by roller with a uniform layer of primer, with an average dry thickness of 1.8 μm.

Heat-sealing is carried out in accordance with the standard settings applied in industrial conditions, using a heat-sealing apparatus with a flexible head, delivering a force of approximately 1560 N. The head is heated at 250° C., so that the temperature at the jar/seal interface reaches 149 to 155° C for a time of application of pressure by the heated head of 1.5 s.

The system thus assembled is hermetic.

The peel forces are measured by peeling at 90° at a speed of 300 mm/min. The typical profile known from peeling on this type of system may be described using three forces: the initial tear force (IT), the peel progression force (PP), and the final tear force (FT).

The values indicated below, and in the following examples, are average values over six jars:

IT=39 N

PP=26.2 N

FT=50.6 N.

The average of IT and FT is 44.8 N. Peeling of the seal is therefore relatively difficult.

EXAMPLE 2

Example 1 is reproduced, except that the heat-sealing primer is mixed into a suspension of $Na^+$ cloisite, dispersed beforehand in deionized water using a deflocculator at a speed of between 500 and 1000 rpm for 10 minutes. The solids contents of the resulting mixture are 9.5% by mass of primer and 0.6% by mass of $Na^+$ cloisite.

A roller is used to apply a homogeneous layer with an average dry thickness of 1.8 μm.

The following measurements are made:

IT=20.6 N

PP=10.5 N

FT=17.2 N.

The average of IT and FT is 18.9 N, corresponding to relatively easy peeling of the seal, with the addition of $Na^+$ cloisite having resulted in a more than 50% reduction in the force required for peeling (by comparison with that of the comparative example, example 1).

The seal does not tear on peeling, and afterward no residue of thermoplastic resin originating from the seal is observed on the rim of the jar. The opening of the packaging may therefore be qualified as clean.

EXAMPLE 3

Example 1 is reproduced, except that the heat-sealing primer is mixed by magnetic stirring into an aqueous suspension of polytetrafluoroethylene (PTFE) whose particles have an average size of 155 nm, the suspension having a pH of 8.5 and containing a surfactant which does not interfere with adhesion to the glass. The solids contents of the resulting mixture are 9.5% by mass of primer and 4.5% by mass of PTFE.

A roller is used to apply a homogeneous coating with an average dry thickness identical to that of the preceding examples.

The following measurements are made:

IT=26 N

PP=9.1 N

FT=24.6 N.

The average of IT and FT is 25.3 N, corresponding to relatively easy peeling of the seal, with the addition of PTFE having resulted in a more than 40% reduction in the force required for peeling.

The same remarks as for example 2 are applicable.

EXAMPLE 4

Example 1 is reproduced, except that the heat-sealing primer is mixed by magnetic stirring into the suspensions of $Na^+$ cloisite and of PTFE of examples 2 and 3. The solids contents of the resulting mixture are adjusted to 9.5% by mass of primer, 0.38% by mass of $Na^+$ cloisite, and 3% by mass of PTFE.

The formulation is applied by the same method and in the same thickness as in the preceding examples.

The following measurements are made:

IT=13.5 N

PP=4.7 N

FT=16 N.

The average of IT and FT is 14.8 N, corresponding to very easy peeling of the seal, with the joint addition of $Na^+$ cloisite and PTFE having resulted in a more than 65% reduction in the force required for peeling.

The same remarks as for example 2 are applicable.

The invention claimed is:

1. A method comprising:

opening a seal comprising a metal foil and a layer comprising a thermoplastic resin via which the seal is heat-sealed to a rim of a glass jar or equivalent container, the rim comprising a heat-sealing primer coating, wherein the heat-sealed seal provides a hermetic closure of the glass jar or equivalent container, wherein an initial and a final tear force on peeling of the seal at 90° at a speed of 300 mm/min is not more than 30 N, wherein the heat-sealing primer coating comprises at least one material selected from the group consisting of an organic material and an inorganic material, and wherein the material comprises at least one filler selected from the group consisting of an organic filler and an inorganic filler.

2. The method of claim 1, wherein the initial and final tear forces are not more than 28 N.

3. The method of claim 1, wherein opening the seal does not leave any residue of the thermoplastic resin layer on the rim.

4. The method of claim 1, wherein the organic material is a dried product of an aqueous dispersion comprising an ethylene-acrylic acid copolymer comprising partially or totally neutralized carboxylic acid functions.

5. The method of claim 4, wherein the inorganic filler is incorporated into the aqueous dispersion of the heat-sealing primer in the form of aggregates or a powder of solid particles having sizes between 1 nm and 20 μm, and wherein the inorganic filler is at least one selected from the group consisting of a clay, kaolin, mica, talc, a silica, a carbonate of an alkaline earth metal, a sulfate of an alkaline earth metal, and a metal oxide.

6. The method claim 5, wherein the inorganic filler particles have sizes between 150 nm and 10 μm.

7. The method of claim 1, wherein: the organic filler is chemically different from the heat-sealing primer coating and the thermoplastic resin; has a melting temperature greater than the heat-sealing primer coating and the thermoplastic resin; and comprises particles having sizes between 1 nm and 20 μm.

8. The method of claim 7, wherein the organic filler particles have sizes between 1 nm and 20 μm.

9. The method of claim 7, wherein the organic filler comprises at least one polymer assembled in the form of a copolymer, a graft polymer, an alloy or a core-shell structure, selected from the group consisting of high-density polyethylene (HDPE), polypropylene (PP), polystyrene (PS), polyamide (PA),polyester, polyvinylidene fluoride (PVDF), polytetrafluoroethylene (PTFE), poly(ethylene glycol) (PEG), poly(ethylene terephthalate) (PET), polymethyl methacrylate (PMMA), and polyetheretherketone (PEEK).

10. The method of claim 1, wherein a dry thickness of the heat-sealing primer coating on the rim is at least 0.2 μm.

11. The method of claim 10, wherein a dry thickness of the heat-sealing primer coating on the rim is at least 0.9 μm.

12. The method of claim 10, wherein a dry thickness of the heat-sealing primer coating on the rim is at least 1.5 μm.

13. The method of claim 1, wherein a dry thickness of the heat-sealing primer coating on the rim is not more than 4 μm.

14. The method of claim 13, wherein a dry thickness of the heat-sealing primer coating on the rim is not more than 3 μm.

15. The method of claim 13, wherein a dry thickness of the heat-sealing primer coating on the rim is not more than 2 μm.

16. The method of claim 1, wherein the glass jar or equivalent container is in the form of a packaging of a processed food product.

17. The method of claim 1, wherein the initial and final tear forces are not more than 25 N.

18. A method, comprising:

opening a seal comprising a metal foil and a layer comprising a thermoplastic resin via which the seal is heat-sealed to a rim of a glass jar or equivalent container, the rim comprising a heat-sealing primer coating, wherein the heat-sealed seal provides a hermetic closure of the glass jar or equivalent container, wherein an initial and a final tear force on peeling of the seal at 90° at a speed of 300mm/min is not more than 30 N, and wherein opening the seal does not leave any residue of the thermoplastic resin layer on the rim.

* * * * *